US005308159A

United States Patent [19]

Misuraca

[11] Patent Number: 5,308,159

[45] Date of Patent: May 3, 1994

[54] CONTINUOUS FLOW MIXER

[75] Inventor: Alfonso M. Misuraca, Somerset, N.J.

[73] Assignee: Excell Design & Construction Services, Inc., Somerset, N.J.

[21] Appl. No.: 120,167

[22] Filed: Sep. 10, 1993

[51] Int. Cl.[5] ..... B01F 5/12; B01F 15/02

[52] U.S. Cl. ..... 366/152; 366/172; 366/182; 366/264; 261/93

[58] Field of Search ..... 366/136-137, 366/151, 152, 160, 168, 172, 182, 262-265, 315, 317; 261/87, 91, 93; 415/58.4, 83; 416/186 R

[56] References Cited

U.S. PATENT DOCUMENTS

| | | | |
|---|---|---|---|
| 1,876,994 | 9/1932 | Mann, Jr. . | |
| 2,072,944 | 3/1937 | Durdin | 261/91 X |
| 2,530,814 | 11/1950 | Becze et al. | 261/93 |
| 2,800,307 | 7/1957 | Putney . | |
| 2,902,941 | 9/1959 | Kiba | 416/186 R |
| 3,204,768 | 9/1965 | Daniel | 366/136 X |
| 3,460,810 | 8/1969 | Mueller . | |
| 4,021,349 | 5/1977 | Kaelin | 261/91 X |
| 4,628,391 | 12/1986 | Nyman et al. | 366/265 |
| 4,778,280 | 10/1988 | Brazelton | 366/136 |
| 5,018,871 | 5/1991 | Brazelton et al. | 366/168 |

*Primary Examiner*—Timothy F. Simone
*Assistant Examiner*—Charles Cooley
*Attorney, Agent, or Firm*—David L. Davis

[57] ABSTRACT

A continuous flow mixer includes an impeller assembly and a mixing chamber formed from concentric inner and outer tubes. The inner tube is radially constrained but is movable along the axis of the outer tube. The impeller assembly is at one end of the mixing chamber and draws fluid along the interior of the inner tube and discharges the fluid to the annular region between the inner and outer tubes. The fluids are introduced into the mixing chamber at the end remote from the impeller assembly and the mixed solution exits the mixing chamber substantially centrally of its length from the annular region.

11 Claims, 3 Drawing Sheets

CONTINUOUS FLOW MIXER

BACKGROUND OF THE INVENTION

This invention relates to mixers (or blenders) and, more particularly, to an improved mixer for mixing a first material with a fluid solvent in a continuous flow process.

To mix a polymer with water, the mixer should have certain characteristics. First, the components should be brought very quickly to the agitator after they come in contact with each other. Second, the solution should be circulated so that the average number of times that the solution passes through the agitator can be calculated and maintained. Further, the solution should be kept flowing in all parts of the mixing chamber without any stagnant or low velocity zones in order to assure that all the materials get mixed and product build up is minimized. It is therefore an object of the present invention to provide a mixer satisfying these requirements.

SUMMARY OF THE INVENTION

The foregoing, and additional, objects are attained in accordance with the principles of this invention by providing a mixer which includes an impeller assembly and a two tube mixing chamber. The mixing chamber is formed from concentric inner and outer tubes. The inner tube is radially constrained but is movable along the axis of the outer tube. The impeller assembly is at on end of the chamber and the fluids to be mixed are introduced into the interior of the chamber remote from the impeller assembly. Fluid is drawn toward the impeller assembly along the interior of the inner tube and is discharged by the impeller assembly into the annular region between the inner and outer tubes. The fluid then travels along this annular region away from the impeller assembly and reenters the inner tube remote from the impeller assembly. The mixed solution exits the mixing chamber substantially centrally of its length from the annular region.

In accordance with an aspect of this invention, the inner tube is biased toward the impeller assembly.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
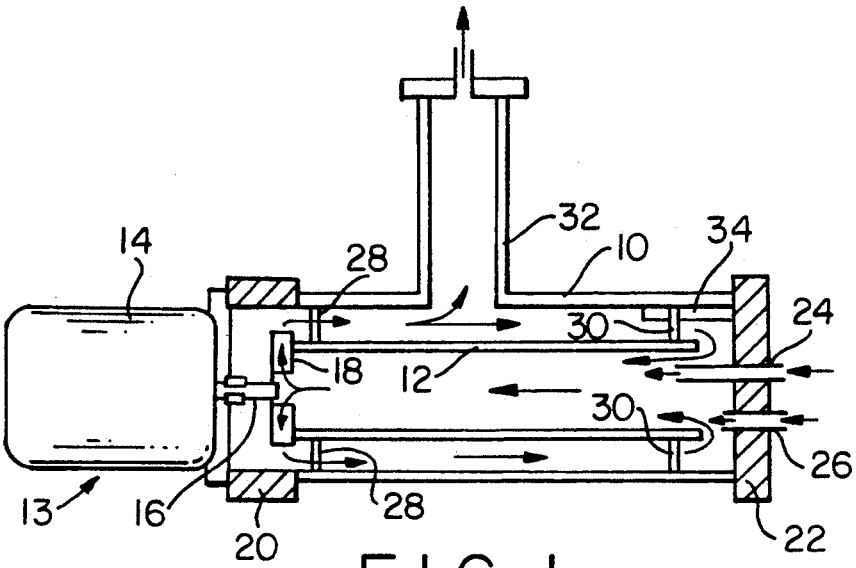
FIG. 1 schematically depicts, partly in cross section, a mixer constructed according to the present invention.

FIG. 1 is a schematic representation of a mixer according to the present invention. As shown therein, the mixer includes a mixing chamber formed by a hollow, generally cylindrical, outer casing 10 open at both ends.

Within the casing 10 is a hollow, generally cylindrical, inner tube 12 open at both ends. The inner tube 12 is shorter than the outer casing 10. An impeller assembly 13 is provided which includes the motor 14 having an output shaft 16 to which is secured the impeller blade assembly 18. Preferably, the motor 14 is secured to the mounting block 20 mounted to a first end of the outer casing 10 and, together with the mounting block 20, seals the first end of the outer casing 10. The second end of the outer casing 10 is sealed by the mounting block 22.

A first inlet 24 extends through the mounting block 22 for introducing polymer into the mixing chamber and a second inlet 26 extends through the mounting block 22 for introducing water into the mixing chamber. While polymer and water are specifically discussed herein, it is contemplated that the described and claimed mixer is suitable for other fluid mixtures.

The inner tube 12 is supported within the outer casing 10 in such a manner so as to allow axial movement and constrain radial movement of the inner tube 12. As shown, this is effected by providing a first plurality of radially outwardly extending pins 28 at a first end of the tube 12 and a second plurality of radially outwardly extending pins 30 at a second end of the tube 12.

The impeller blade assembly 18 is located within the outer casing 10 and is arranged to receive fluid at a central region and discharge the fluid outwardly toward the outer casing 10. This sets up a flow pattern as shown by the arrows. Thus, fluid introduced through the inlets 24 and 26 is drawn by the impeller blade assembly 18 toward the left through the inner tube 12. This fluid is then discharged outwardly toward the outer casing 10 and travels toward the right through the annular region between the inner tube 12 and the outer casing 10. A portion of the fluid in this annular region is discharged from the mixing chamber through the outlet 32 which communicates with the annular region substantially centrally of the length of the outer casing 10. The remainder of the fluid travels to the right end of the annular region and then back into the interior of the inner tube 12. By knowing the flow rates at the inlets 24 and 26, the rate of flow through the impeller blade assembly 18 and the volume of the mixing chamber, the "residence time" within the mixing chamber can be calculated. This residence time is important for the proper mixing of certain chemicals.

Figure 2:
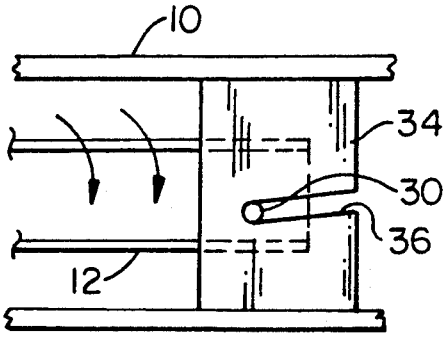
FIG. 2 shows an inventive arrangement for biasing the inner tube toward the impeller assembly.

It is desired that the inner tube 12 be as close to the impeller blade assembly 18 as possible. Toward this end, an arrangement for biasing the inner tube 12 toward the left is provided. This arrangement is shown in FIG. 2 which shows a member 34 installed in the outer casing 10. The member 34 is formed with an elongated guide channel 36 which is at an acute angle relative to the major axis of the inner tube 12. The impeller blade assembly 18 is configured to set up a generally helical flow pattern in the annular region between the inner tube 12 and the outer casing 10, as shown by the arrows in FIG. 2. This helical flow pattern acts to rotate the inner tube 12. Since the pin 30 is trapped within the guide channel 36, full rotation of the inner tube 12 is prevented. However, because of the angle of the guide channel 36, partial rotation of the inner tube 12 occurs, which causes the inner tube 12 to be moved to the left toward the impeller blade assembly 18.

Figure 3:
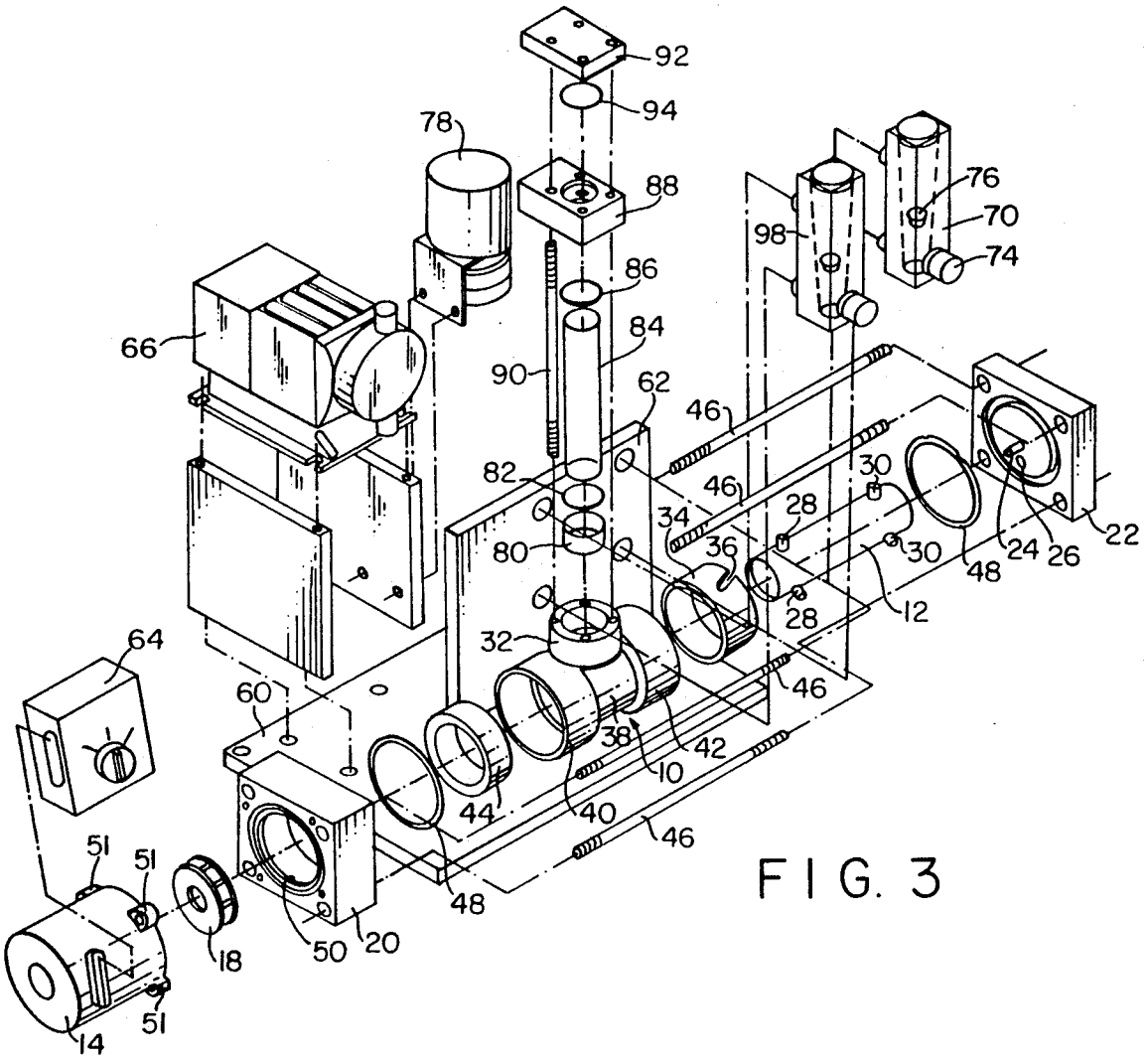
FIG. 3 is an exploded perspective schematic view of an illustrative embodiment of a mixer constructed according to the present invention.

FIG. 3 shows an illustrative embodiment of a mixer constructed according to the present invention which embodies the concepts illustrated in FIGS. and 2. Thus, the outer casing 10 is illustratively a standard plastic Tee fitting which has a central region 38 and enlarged end regions 40 and 42, with the outlet 32 communicating with the central region 38. A spacer 44 is press fit into the end region 40 to provide a bearing surface for the pins 28 on the inner tube 12. Illustratively, there are three equiangularly spaced pins 28. The member 34 is press fit into the end region 42. Illustratively, there are three equiangularly spaced pins 30 on the inner tube 12. One of the pins 30 is longer than the other two so that it extends into the guide channel 36, with the interior of the member 34 providing a bearing surface for the other two of the pins 30.

The mounting blocks 20 and 22 are secured to the ends of the outer casing 10 by means of threaded rods 46. Sealing is effected by the O-rings 48 secured under pressure between the ends of the outer casing 10 and the faces of the mounting blocks 20 and 22. The mounting block 20 is formed with an enlarged central aperture 50 which is sufficient in size so that the impeller blade assembly 18 can pass therethrough. The motor 14 is secured directly to the mounting block 20 via the ears 51 to provide a seal for the aperture 50, by means of an O-ring (not shown).

Figure 4:
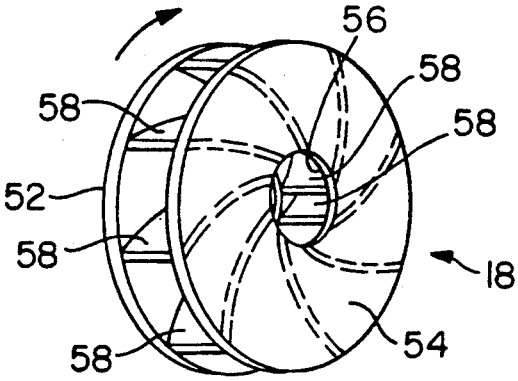
FIG. 4 is a perspective view of an illustrative impeller blade assembly which may be utilized in the mixer of FIG. 3.

An illustrative design for the impeller blade assembly 18 is shown in FIG. 4. As shown, the blade assembly 18 includes a circular planar plate 52 which is secured to the motor output shaft 16 (FIG. 1) in such a manner that the plane of the plate 52 is orthogonal to the axis of the shaft 16 and the center of the plate 52 is aligned with the axis of the shaft 16. A second circular plate 54 is provided. The plate 54 has a central circular opening 56 which is concentric with the axis of the motor output shaft 16. The outer diameter of the second plate 54 is substantially the same as the outer diameter of the first plate 52. A plurality of substantially identical curved vanes 58 are between and secured to both the plates 52 and 54 and extend from the periphery of the opening 56 to the outer peripheries of the plates 52 and 54. Rotation of the blade assembly 18 in the direction shown by the arrow causes fluid to be drawn into the opening 56 and discharged outwardly from the regions between the vanes 58, as is known in the art.

The entire mixer structure is supported on horizontal mounting plate 60 and vertical mounting plate 62. A control box 64 is mounted near the motor 14 and is electrically connected thereto for selectively controlling the operation of the motor 14. The control box 64 is connected to a source of electrical power. For controlling the flow of the polymer through the inlet 24, there is provided a metering pump 66 whose inlet is connected to a supply 68 of the polymer (FIG. 5) and whose outlet is coupled to the inlet 24 at the exterior of the mounting block 22. (So as not to unduly crowd the drawing, tubing and piping is not shown in FIG. 3, but it is understood that such tubing and piping is provided between the various components.)

To control the flow of water, a flowmeter 70 is provided. The flowmeter 70 is coupled between a supply 72 of water (FIG. 5) and the inlet 26 at the exterior of the mounting block 22. Illustratively, the flowmeter 70 is a Rotameter which has a flow control knob 74 and a visible float 76 for indicating the rate of flow through the flowmeter 70. A differential pressure switch 78 is coupled across the flowmeter 70 and senses the absence of water flow to turn off the motor 14 and the metering pump 66.

As shown, a spacer SO is press fit into the outlet 32 and an O-ring 82 is placed thereover. A transparent sight tube 84 is installed over the O-ring 82 and the sight tube 84 is capped by an O-ring 86 and a mounting block 88. Threaded rods 90 (only one of which is shown) extend between the outlet 32 and the mounting block 88 for holding the outlet structure together. The purpose of the transparent sight tube 84 is to allow an operator to see the flow of the mixed solution. A cover member 92 caps the mounting block 88, with appropriate sealing being provided by the O-ring 94. The mixed solution exits the mounting block 88 via the outlet 96 (FIG. 5).

There are circumstances where it is desired to provide further dilution of the mixture. Toward this end, there is provided a second flowmeter 98, which is connected between the water supply 72 and an auxiliary inlet 100 (FIG. 5) of the mounting block 88. Accordingly, by controlling the flowmeter 98, additional water may be added to the mixture.

Figure 5:
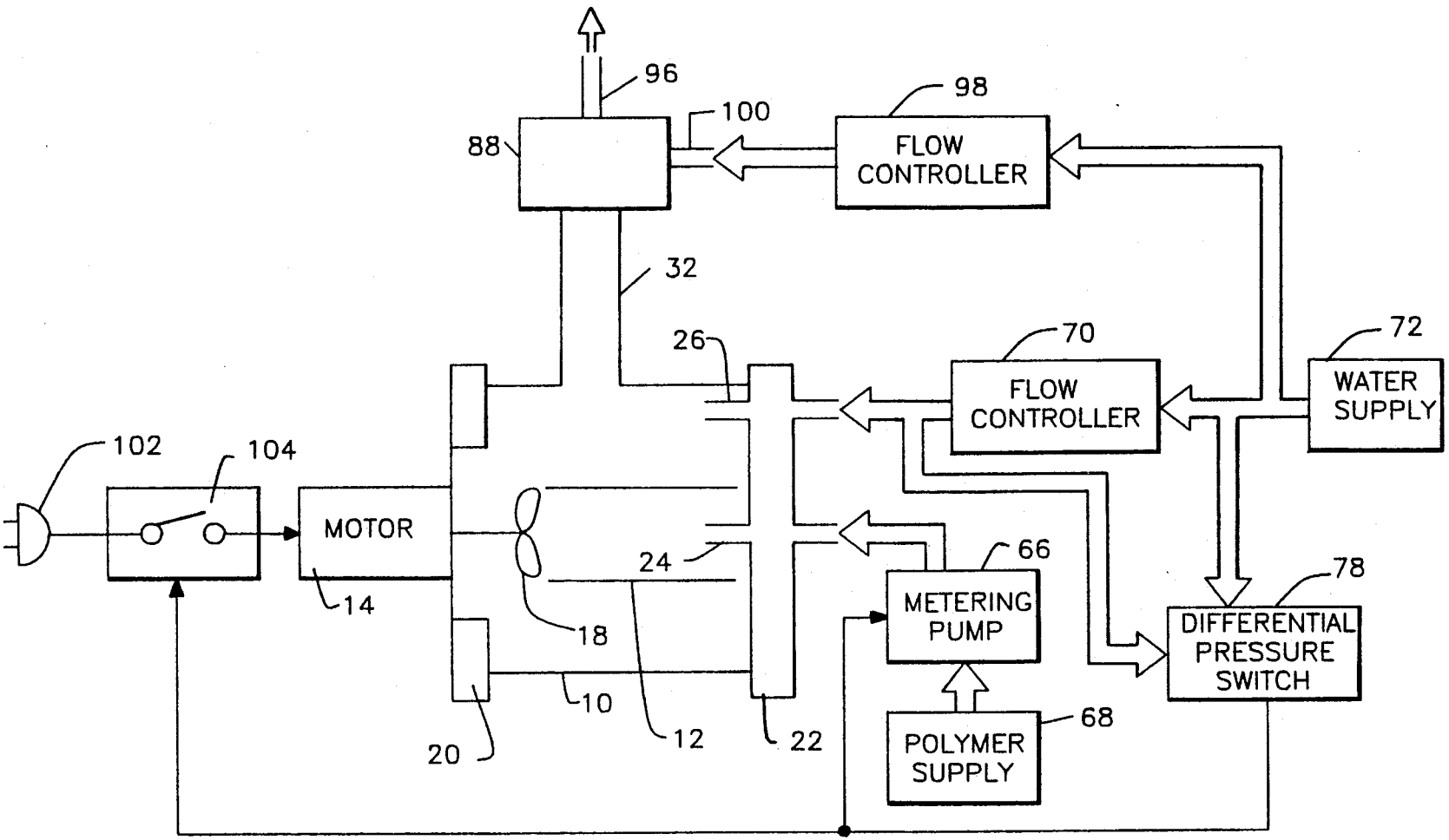
FIG. 5 is a block diagram of the mixer of FIG. 3, showing fluid flow with double line arrows and electrical signal flow with single line arrows.

FIG. 5 illustrates the fluid and electrical flow paths of the mixer of FIG. 3. Thus, power is supplied to the motor 14 from commercially available power by means of the standard plug 102 coupled to the motor 14 through the controllable switch 104 within the control box 64 (FIG. 3). When the differential pressure switch 78 senses water flow through the flow controller 70, the switch 104 is closed to power the motor 14 and spin the impeller blade assembly 18. At the same time, the metering pump 66 is turned on to supply polymer to the mixing chamber. If for some reason the water ceases flowing through the flow controller 70, this is sensed by the differential pressure switch 78, which turns off the motor 14 and the metering pump 66.

The dual tube mixing chamber according to the present invention is advantageous in that it allows keeping the mixing chamber as compact as possible, and at the same time provides a path for the solution to flow through as it recirculates. Preferably, the cross sectional areas of the inner tube 12 and the annular region between the inner tube 12 and the outer casing 10 are equal, so that the fluid velocities in these areas can be equal. Giving the solution a flow path allows measuring the velocity in the path, if desired. Giving the solution a flow path through all areas of the mixing chamber assures that there are no stagnant areas where product build up can occur. Circulation through the dual tube area is assured by keeping one end of the inner tube 12 as close as possible to the impeller blade assembly 18. As previously described, the helical flow pattern in the annular region between the inner tube 12 and the outer casing 10 provides the biasing force which causes the end of the inner tube 12 to engage the face of the circular plate 54. While the biasing force generated by the helical flow is sufficient to keep the inner tube 12 in contact with the plate 54, such force is relatively small and does not adversely effect rotation of the impeller blade assembly 18.

The dual tube mixing chamber which has been described is limited in its length to diameter ratio. As the ratio increases, the time between passes through the impeller blade assembly increases. Further, fluid friction increases, which results in reduced pumping rates. The dimensions of the mixing chamber should be optimized for each particular application.

Accordingly, there has been disclosed an improved continuous flow mixer. While an illustrative embodiment of the present invention has been disclosed herein, it is understood that various modifications and adaptations to the disclosed embodiment will be apparent to those of ordinary skill in the art and it is intended that this invention only be limited by the scope of the appended claims.

What is claimed is:

1. Apparatus for mixing a first material with a fluid solvent, comprising:

a hollow generally cylindrical outer casing having a first open end and a second open end;

first sealing means for sealing said first open end of said outer casing;

second sealing means for sealing said second open end of said outer casing;

a hollow generally cylindrical inner tube having a first open end and a second open end, said inner tube having a length less than the length of said outer casing and exterior cross sectional dimensions less than the interior cross sectional dimensions of said outer casing;

an impeller assembly mounted to said first sealing means inside said outer casing, said impeller assembly having an inlet port substantially centrally of said outer casing and at least one discharge port directing discharged fluid outwardly toward said outer casing;

support means for supporting said inner tube within said outer casing between said impeller assembly and said second sealing means so as to maintain a generally annular region between said inner tube and said outer casing, said support means having means for allowing axial movement and constraining radial movement of said inner tube, with said inner tube first open end being closely adjacent said impeller assembly and there being a space between said inner tube second open end and said second sealing means;

first inlet means for introducing said first material to the interior of said outer casing;

second inlet means for introducing said fluid solvent to the interior of said outer casing; and an outlet extending through said outer casing between said outer casing first and second ends and communicating with said annular region.

2. The apparatus according to claim 1 wherein said support means includes a first plurality of radially outwardly extending pins secured to the exterior of said inner tube adjacent said inner tube first open end and a second plurality of radially outwardly extending pins secured to the exterior of said inner tube adjacent said inner tube second open end.

3. The apparatus according to claim 1 wherein said support means includes biasing means for biasing said inner tube toward said impeller.

4. The apparatus according to claim 3 wherein said support means includes a first plurality of radially outwardly extending pins secured to the exterior of said inner tube adjacent said inner tube first open end and a second plurality of radially outwardly extending pins secured to the exterior of said inner tube adjacent said inner tube second open end, said impeller assembly sets up a generally helical flow pattern in said annular region, and said biasing means includes an elongated guide channel adapted to accept one of said second plurality of pins, said guide channel being at an acute angle relative the major axis of said inner tube so that the helical flow pattern in the annular region acts to rotate said inner tube and the interaction between said one of said second plurality of pins and said guide channel tends to move said inner tube toward said impeller assembly.

5. The apparatus according to claim 1 wherein said first inlet means includes a first conduit extending through said second sealing means.

6. The apparatus according to claim 5 wherein said second inlet means includes a second conduit extending through said second sealing means.

7. The apparatus according to claim 1 wherein said impeller assembly includes:

a motor having an output shaft;

a first circular planar plate member secured to said motor output shaft, the plane of said first plate member being orthogonal to the axis of said shaft and the center of said first plate member being aligned with the axis of said shaft;

a plurality of curved vanes secured to said first plate member and each extending from a first circle concentric with the center of said first plate member to a larger second circle concentric with the center of said first plate member, said plurality of curved vanes being substantially identical and curved in the same direction between the first and second circles; and a second circular planar plate member secured to said plurality of curved vanes so as to be parallel to and spaced from said first plate member, the center of said second plate member being aligned with the axis of said shaft, said second plate member having a central circular opening concentric with said shaft axis and of substantially the same size as said first circle, and the outer periphery of said second plate member being substantially the same size as said second circle.

8. The apparatus according to claim 1 wherein said first inlet means includes means for controlling the flow of said first material.

9. The apparatus according to claim 1 wherein said second inlet means includes means for controlling the flow of said fluid solvent.

10. The apparatus according to claim 9 further including:

means for sensing the flow of said fluid solvent through said second inlet means; and means responsive to the sensed flow being below a predetermined threshold for stopping the flow of said first material through said first inlet means and for stopping the operation of said impeller assembly.

11. The apparatus according to claim 1 further including means for supplying additional fluid solvent directly to said outlet.

* * * * *